US010336570B2

(12) United States Patent
Beggs

(10) Patent No.: US 10,336,570 B2
(45) Date of Patent: Jul. 2, 2019

(54) CORD ORGANIZER

(71) Applicant: Christopher J. Beggs, Whittier, CA (US)

(72) Inventor: Christopher J. Beggs, Whittier, CA (US)

( * ) Notice: Subject to any disclaimer, the term of this patent is extended or adjusted under 35 U.S.C. 154(b) by 328 days.

(21) Appl. No.: 15/385,722

(22) Filed: Dec. 20, 2016

(65) Prior Publication Data

US 2017/0190541 A1 Jul. 6, 2017

Related U.S. Application Data

(60) Provisional application No. 62/275,760, filed on Jan. 6, 2016.

(51) Int. Cl.

*B65H 75/44* (2006.01)
*H04R 1/10* (2006.01)
*B65H 75/40* (2006.01)

(52) U.S. Cl.

CPC ..... *B65H 75/4471* (2013.01); *B65H 75/406* (2013.01); *B65H 75/4442* (2013.01); *H04R 1/1033* (2013.01); *B65H 2701/3919* (2013.01); *H04R 1/1016* (2013.01)

(58) Field of Classification Search

CPC ..... B65H 75/406; B65H 75/4442; B65H 75/4471; B65H 2701/3919

See application file for complete search history.

(56) References Cited

U.S. PATENT DOCUMENTS 4,150,798 A * 4/1979 Aragon ..... H02G 11/02 191/12.2 R
4,467,979 A * 8/1984 Koehler ..... B65H 75/40 191/12.4
6,079,657 A * 6/2000 Hwang ..... B65H 75/406 191/12.4
8,882,016 B1 * 11/2014 Melvin ..... B65H 75/4431 242/395.1
2004/0089760 A1 * 5/2004 Wu ..... B65H 75/406 242/388.1
2006/0266864 A1 * 11/2006 Hade ..... B65H 75/406 242/370
2007/0108333 A1 * 5/2007 Kuramoto ..... B65H 75/406 242/395
2013/0313352 A1 * 11/2013 Alexandre ..... B65H 75/34 242/388

(Continued)

FOREIGN PATENT DOCUMENTS

GB 2469302 A * 10/2010 ..... B65H 75/406

*Primary Examiner* — William E Dondero

(74) *Attorney, Agent, or Firm* — Lewis Roca Rothgerber Christie LLP

(57) ABSTRACT

A cord or cable organizer includes a housing further including a housing inner circular track, an opening, and an attachment hole therein, a rotational component further including at least one hole on a surface of the rotational component, further including a rotational inner circular track wherein the rotational inner circular track operably connects with the housing inner circular track, thereby providing friction, and an insertion hole receiver, and a plug, wherein the plug is inserted through the attachment hole on the housing and continues to the insertion hole receiver whereby the plug operably holds the cable organizer together.

12 Claims, 6 Drawing Sheets

(56) References Cited

U.S. PATENT DOCUMENTS

| | | | | |
|---|---|---|---|---|
| 2015/0265036 | A1* | 9/2015 | McCurdy | A45F 5/021<br>224/660 |
| 2017/0013343 | A1* | 1/2017 | Tomlinson | B65H 75/4431 |

* cited by examiner

CORD ORGANIZER

CROSS-REFERENCE TO RELATED APPLICATION

This application claims the benefit of U.S. Provisional Application No. 62/275,760, filed Jan. 6, 2016, the entire content of which is incorporated herein by reference.

TECHNICAL FIELD

The present invention relates to a cord or cable organizer.

BACKGROUND OF THE INVENTION

The increasing use of portable electronic appliances has made accessories more prevalent in daily life. For example, headphones, cables, earphones, earbuds, and portable power packs are commonly used. One of the most frequently used accessories is a cord or cable, which may electronically connect an electronic appliance to a user to transmit data or music. A cord or cable may also be used to recharge the portable electronic appliance in order to implement practical functionalities. However, a cord or cable of a considerable length, does not have a proper organizing system. As such, when being carried or in use, the cord or cable is often intertwined into a messy ball, which may sometimes become entangled. For example, the cord of earbuds often intertwine into a messy ball when placed in a pocket. Untying the tied up cord or cable is time consuming and an extremely frustrating burden of inconvenience. In addition, current cable organizers typically have coils, springs, and other biasing devices to produce tension. These devices add to the cost of production and make the organizer more complicated to use. They also can cause undue wear or damage to cords or cables due to the tension they place upon them.

To overcome the shortcomings of existing organizers, the present invention provides in one or more embodiments a cord or cable organizer to mitigate or obviate the aforementioned problems. In addition, embodiments of the present invention provide a cord or cable organizer that is easy to use, is constructed of fewer parts, is simpler, does not require an independent tension mechanism, and is more effective than what is currently available.

SUMMARY OF THE INVENTION

Embodiments of the present invention provide simplified construction and a reduction in the number of parts for a cord organizer. The reduction in the number of parts has several benefits and advantages over what is currently available. First, the reduction in the number of parts makes it easier to use. Second, since there are less moving parts, there is a reduced likelihood of the cable organizer breaking. Third, because of the reduced number of parts, the cost of manufacturing is decreased. Fourth, since the cord organizer uses natural friction to hold the cord or cable in place, there may not be constant wear and tear, and thereby may prolong the life of the cord or cable.

A cord or cable organizer includes a housing further including a housing inner circular track, an opening, and an attachment hole therein, a rotational component further including at least one hole on a surface of the rotational component, further including a rotational inner circular track wherein the rotational inner circular track operably connects with the housing inner circular track, thereby providing friction, and an insertion hole receiver, and a plug, wherein the plug is inserted through the attachment hole on the housing and continues to the insertion hole receiver whereby the plug operably holds the cable organizer together.

The rotational component may include at least two holes on the surface.

The cable organizer may include a side wall for the housing that is an exterior surface of the cable organizer that is opposite an exterior side wall of the rotational component once assembled.

The cable organizer may include a circumferential edge wall that is a narrow edge that extends orthogonally from the side wall for the housing.

A lip that is a narrow flange may extend inward orthogonally from the circumferential edge wall.

A curved arcuate slice in the housing that removes a portion of the side wall, circumferential edge, and lip may create an edge opening.

A friction may be provided by a surface texture used for the inner track of the housing or the rotational component or both.

A plug may have an orthogonal shape and the hole attachment may have a matching orthogonal shape wherein the orthogonal shape plug fits securely into the orthogonal shape hole attachment.

The cable organizer may include a harness wherein the harness attaches the cable organizer to a user.

The cable organizer may be substantially square shaped.

The cable organizer may be substantially shaped like an apple.

At least a portion of the cable organizer may glow in the dark.

A cable organizer includes a housing, a rotational component operably connected to the housing so as to be able to rotate with respect to the housing against friction, means for ingress for allowing a cable to enter the housing, and means for egress for allowing the cable to exit the housing.

The rotational component may further include at least one hole on a surface to provide the means for egress.

The cable organizer may include a side wall for the housing that is an exterior surface of the cable organizer that is opposite an exterior side wall of the rotational component once assembled.

The cable organizer may include a circumferential edge wall that is a narrow edge that extends orthogonally from the side wall for the housing.

A lip that is a narrow flange may extend inward orthogonally from the circumferential edge wall.

The means for ingress may be a curved arcuate slice in the housing that removes a portion of the side wall, circumferential edge, and lip to create an edge opening.

The cable organizer may include a harness wherein the harness attaches the cable organizer to a user.

At least a portion of the cable organizer may glow in the dark.

In addition, unlike existing organizers, the cord organizer may include more than one insertion hole on the surface, which would allow the user to wrap more than one cord or earbud in the organizer at the same time. An embodiment of the organizer that includes more than one insertion hole to allow the user to wrap more than one cord may involve adjusting the size of the organizer to accommodate the wrapping of more than one cord.

BRIEF DESCRIPTION OF THE DRAWINGS

The features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

Figure 1:
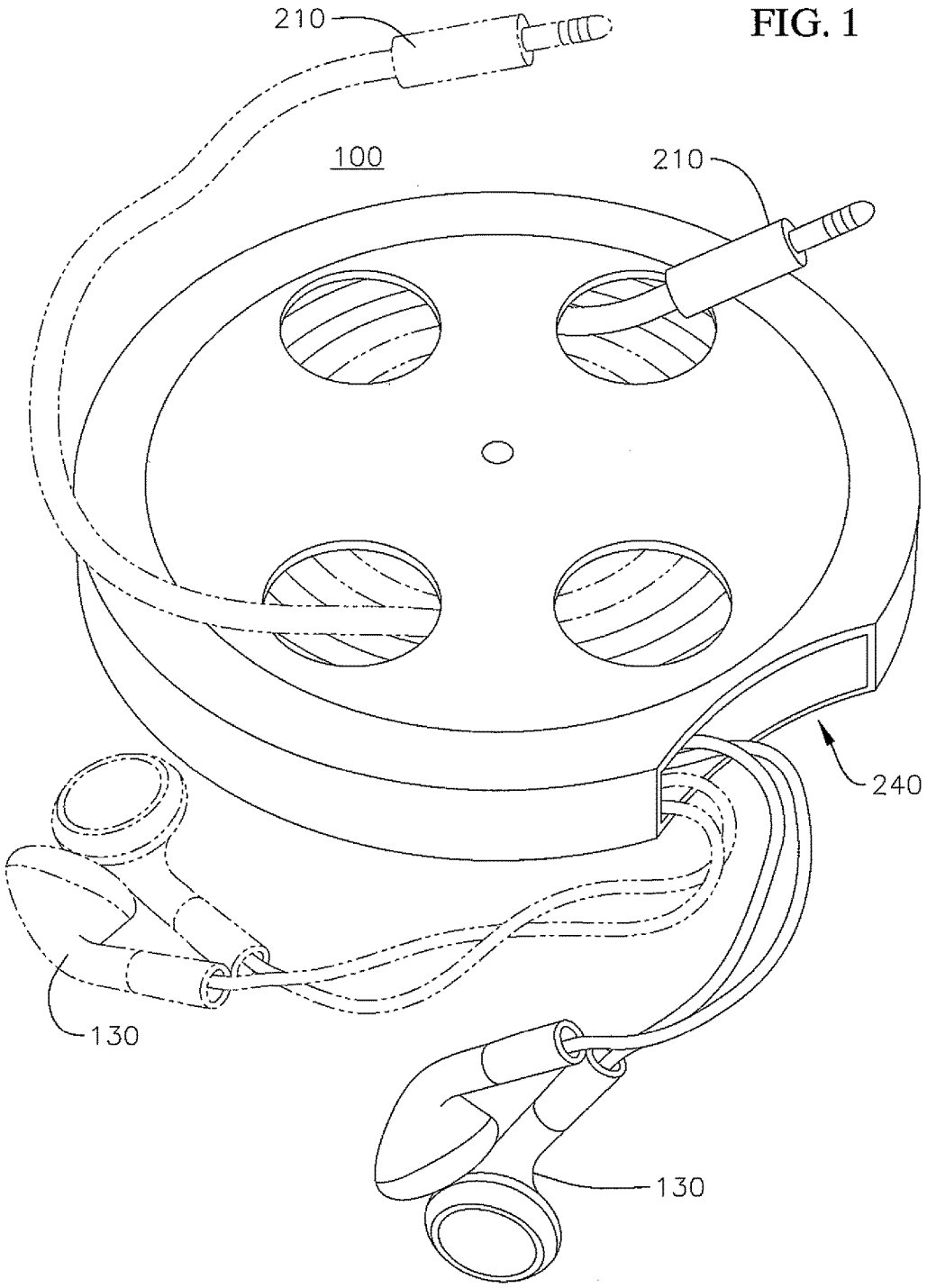
FIG. 1 is a perspective view of an embodiment of the cord organizer.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

For the purpose of the present application the terms headphones, earbuds, earphones, USB hub, and any other device that plugs into a computing device are interchangeable. In addition, the terms cable or cord will be used to describe any operable connection means between a computing device and an accessory and is not intended to limit the types of connection means but will only be used so in this application to describe an embodiment of the present invention.

Embodiments of the present invention provide simplified construction and a reduction in the number of parts. The reduction in the number of parts has several benefits and advantages over what is currently available. First, the reduction in the number of parts makes it easier to use. Second, since there are less moving parts, there is a reduced likelihood of the cable organizer breaking. Third, because of the reduced number of parts, the cost of manufacturing is decreased. Fourth, since the cord organizer uses natural friction to hold the cord or cable in place, there may not be constant wear and tear, and thereby may prolong the life of the cord or cable.

Now referring to FIG. 1, a perspective view of an embodiment of the present invention is shown. The cord organizer 100 provides an easy method to wrap earbuds 130 used with devices such as cell phones, iPods, MP3 players, and other similarly sized cables such as USB cables, etc. The cord organizer may allow the user to keep earbud wires untangled and ready to use without spending time untangling. The thickness and width of the organizer is slim enough to fit into a typical shirt pocket or small hand purse. The cords or earbuds may be manually wound into the organizer. The organizer may also allow for leaving a portion of one or both ends of the cord exposed to facilitate use of the cords at the desired length without excessive length of the cord getting in the way. This may allow the user to use earbuds with a cell phone while storing the organizer in a shirt pocket without the cord getting tangled.

Figure 2:
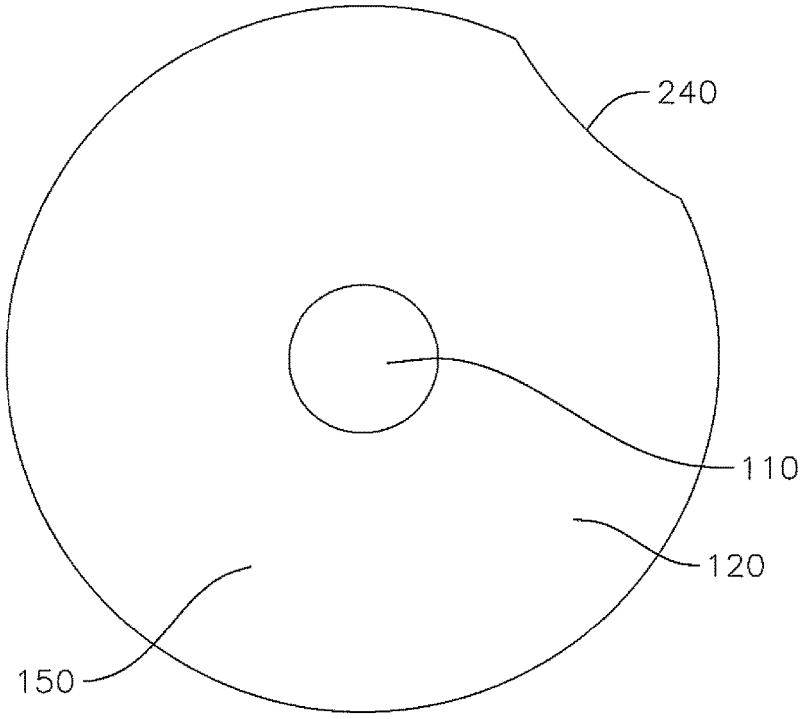
FIG. 2 is a top view of an embodiment of the cord organizer.
Figure 3:
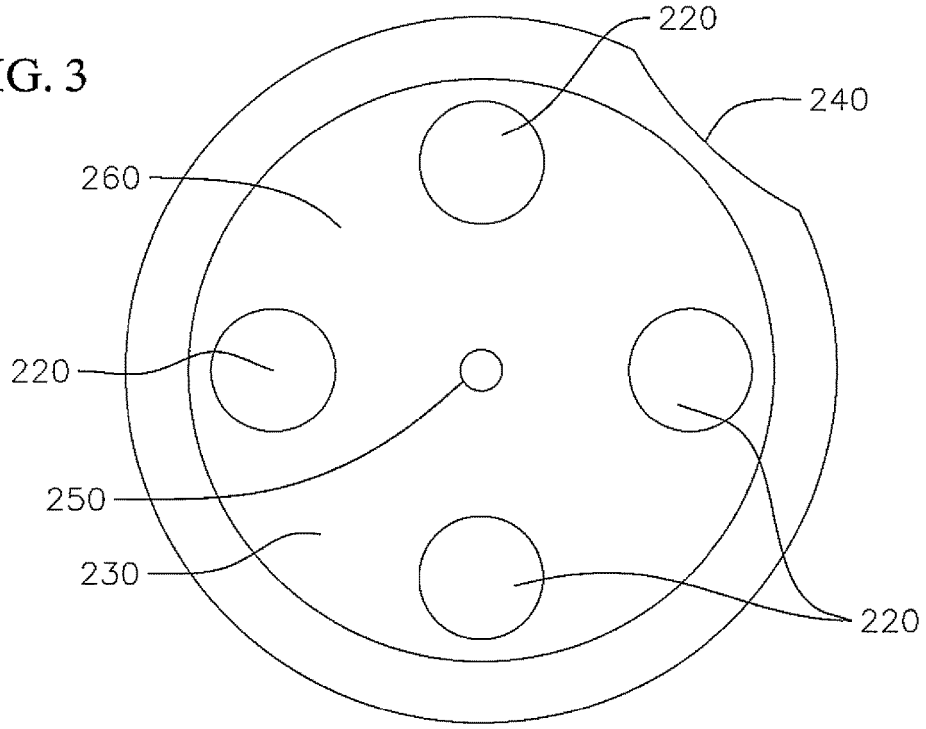
FIG. 3 is a bottom view of an embodiment of the cord organizer.

Now referring to FIGS. 2 and 3, a top view and bottom view of an embodiment of the cord organizer are seen. The cord or cable organizer may include a housing 120, a rotational component 230, and a plug 110. In one or more embodiments, the cord or cable organizer may be in a circular or hockey puck-like shape.

Figure 4:
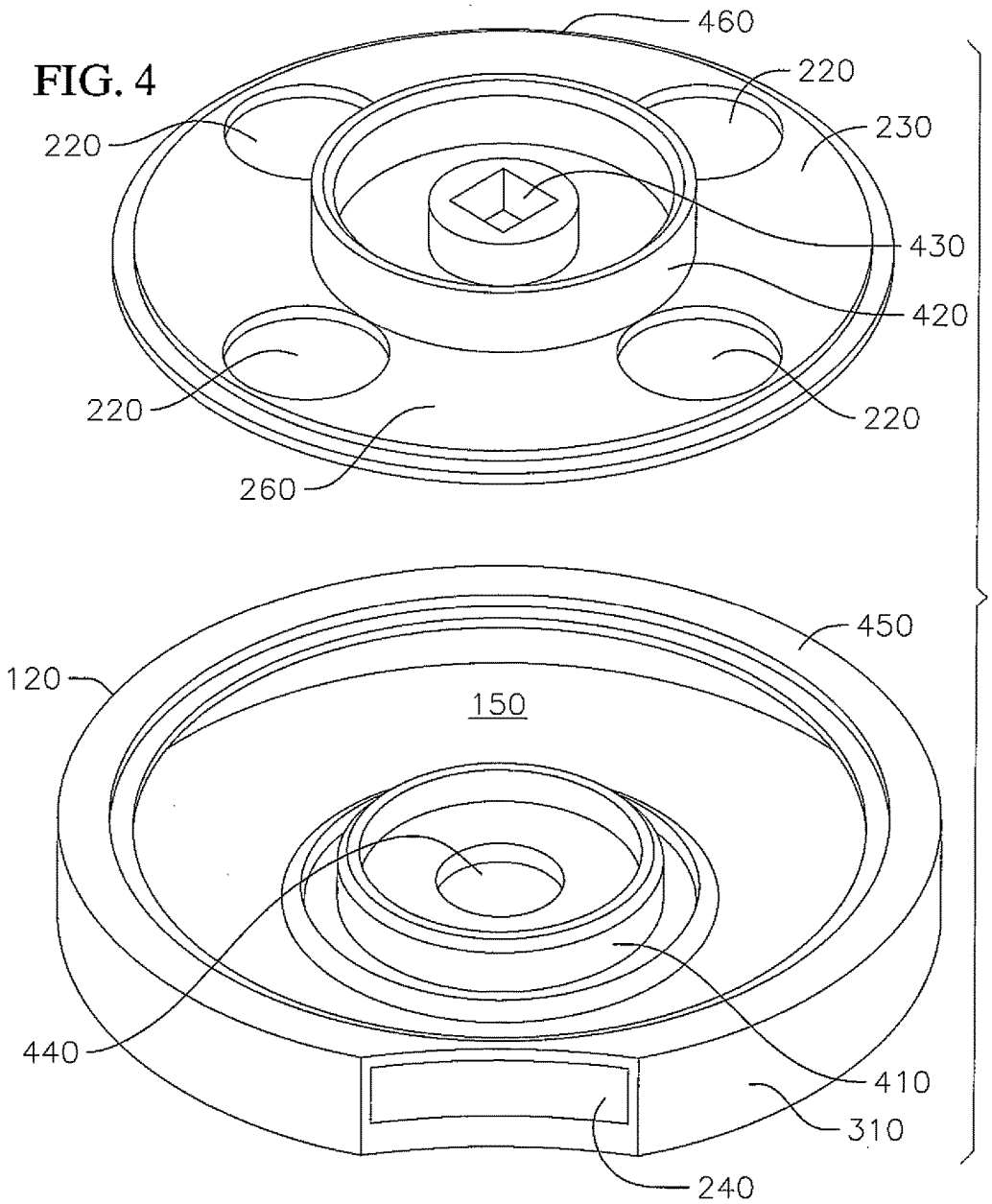
FIG. 4 is a perspective view of a rotational component and housing.

Now referring to FIG. 4, perspective views of a rotational component and housing are seen. The rotational component and housing are separated from each other and opened up to expose how the two pieces interact with each other. The housing 120 may look like a hockey puck hollowed out from one side and may include a side wall 150 (see FIG. 2), a circumferential edge wall 310, a lip 450, an inner circular track 410, an opening 240 in the edge wall, and an attachment hole 440 therein. The side wall 150 (see FIG. 2) may be the exterior surface of the organizer that will be opposite the exterior side wall of the rotational component once the two are assembled. In addition, the side wall may be an interior surface of the organizer that receives the rotational component when assembled. The circumferential edge wall may be a narrow edge that extends orthogonally from the side wall for the housing. Moreover, there may be a curved arcuate slice in the housing that removes a portion of the side wall, circumferential edge, and lip to create an edge opening 240. The lip may be a narrow flange that extends inward orthogonally from the circumferential edge wall. The lip may come in contact with the rotational component when assembled.

The housing inner circular track 410 may extend out from the interior side wall in the same direction as the circumferential edge wall and may be concentrically positioned relative to the lip. The inner circular track may have a smaller circumference than the lip. Further, the inner circular track may be sized and configured to mate with the rotational component. As a non-limiting example, the housing inner circular track may fit with the rotational component inner circular track by being slightly larger than the rotational component inner circular track. Conversely, the rotational component inner circular track may be slightly larger than the housing inner circular track.

The attachment hole 440 may be sized and configured to be located between the center and edge of the lip. The attachment hole may have a circular opening that receives an attachment hole receiver 430 of the rotational component when assembled. As a non-limiting example, the attachment hole may have a groove to accommodate the inserted plug thereby allowing the plug to be flush with the surface of the housing.

The rotational component 230 (see FIG. 3) may look like the missing side surface of a hollowed out hockey puck as described previously. The rotational component 230 may include at least one insertion hole 220, on one quadrant, on a side wall 260, an inner circular track 420, and the attachment hole receiver 430. The rotational component may have a different hole on each quadrant on the side wall 260. The side wall 260 may be the exterior surface of the organizer that forms the opposite side of the exterior of the housing. In addition, the side wall 260 may be an interior surface of the organizer that receives the housing when assembled. The side wall 260 may have an inner circular track 420 wherein the rotational inner circular track is adapted to operably connect with the housing inner circular track, so as to provide friction therebetween.

The rotational component inner circular track 420 may extend out from the interior side wall of the rotational component and may be concentrically positioned to an edge 460. The inner circular track may have a smaller circumference than the edge. Further, the rotational component inner circular track 420 may be sized and configured to make contact with the housing inner circular track 410. As a non-limiting example, the rotational component may have one insertion hole. The rotational component may, however, have more than one insertion hole and would allow for more than one earbud or cord to be wrapped at the same time.

The attachment hole receiver 430 may be sized and configured to be located between the center and edge. The attachment hole receiver may be configured to align the attachment hole to receive the plug 110 when assembled.

Figure 5:
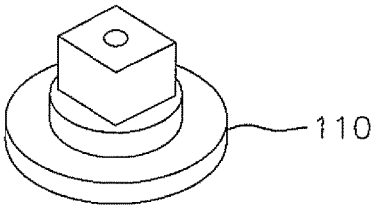
FIG. 5 is a perspective view of a plug.

Now referring to FIG. 5, a perspective view of the plug is seen. The plug 110 may be adapted to be inserted through the attachment hole 440 on the housing and continue into the rotational component attachment hole receiver 430, whereby the plug operably holds the cord or cable organizer together. As a non-limiting example, as seen in FIG. 5, the plug may have an orthogonal shape which may fit more securely into the hole attachment if the hole attachment also has an orthogonal shape to accommodate the plug.

There may be different fabrication methods for the components of the organizer. As a non-limiting example, the housing, rotational component, or the plug may be fabricated by the use of injection molding. As another non-limiting example, the housing, rotational component, or the plug may be fabricated by the use of a 3-D printer.

As yet another non-limiting example, one or more of the components may be wood or stamped metal. In addition, metallic screws or plastic plugs may be used to attach the components together.

The materials used to manufacture the components of the cord organizer may vary. As a non-limiting example, the material used to make the housing, rotational component, or the plug may be polyurethane. However, any material that is light and durable would be acceptable.

As stated previously, as a non-limiting example, wood, stamped metal or plastic may be used to manufacture the components. Moreover, metallic screws or a plastic plug may be used to attach some components together.

Referring back to FIG. 4, the organizer may be assembled by placing the housing 120 on top of the rotational component 230. More specifically, the lip 450 may make contact with the rotational component. Further, the rotational component inner track 420 may make contact with the housing inner track 410. Once the housing is securely in place, the attachment hole receiver 430 may be aligned with the attachment hole 440. Then, the plug 110 may be inserted into the attachment hole receiver 430. Next, a screw or pin may be inserted through the surface of the rotational component to secure the plug. The cord or cable organizer may then be held together.

The natural friction between the inner track of the housing and the inner track of the rotational component may provide sufficient friction to hold the retracted cord so it will stay in place in normal storage situations. The fit between the housing inner track and the rotational component inner track may be tight and may provide a friction fit. The friction fit may hold the two inner tracks in place and thereby hold the housing and rotational components normally in place but not enough friction that cannot be overcome when needed to rotate the organizer. The user may use the appropriate amount of force to overcome the natural friction to rotate either the housing or rotational component while keeping the other piece stationary, thereby wrapping, or unwrapping the cord from the organizer. Typically the force involved to overcome the friction between the components will be such that can be overcome by the hand and arm strength of an average user.

As a non-limiting example, the amount of friction provided may be adjusted by the type of material used for the inner track of the housing or the rotational component or both.

As another non-limiting example, the amount of friction provided may also be adjusted by the surface texture used for the inner track of the housing or the rotational component or both. If a rougher surface is used, then there may be more friction and consequently more force would be needed to overcome the stationary phase. Conversely, if a smoother surface texture is used, then there may be less force needed to overcome the stationary phase.

As another non-limiting example, the amount of friction provided may be adjusted by using a combination of materials used and the surface texture of the inner track.

The choice of materials, tolerances, and attachment method may contribute to the overall friction.

Referring back to FIGS. 2 and 3, in one or more embodiments, the organizer may be used in several ways. Once the opening 240 is lined up with an insertion hole 220 by turning the housing and rotational component relative to one another, a cord outlet 210 may be inserted through the opening 240 through to an insertion hole 220 on the housing 120. While the cord outlet is held in place through the hole and on the exterior side wall of the rotational component, while the rotational component is stationary, the user would rotate the housing altogether, and the rest of the cord may wrap around the inner circular track of the rotational component 230. The cord may wrap around the inner circular track of the rotational component until the cord is fully retracted and only earbuds or a USB hub would be exposed in the opening 240 (see FIG. 1).

To release or unwrap the cord, the user may hold the rotational component and pull the ea bud. This may unwind the cord from the organizer.

Referring back to FIG. 1, a perspective view of the cord organizer with four holes in the housing is shown. Wrapping more than one cord may require an additional step. The second cord shown in phantom lines illustrates how, similar to wrapping one cord, once the opening 240 is lined up with a hole 220, a cord outlet 210 may be inserted through the opening 240 through to a hole 220 on the housing 120. While the cord outlet is held in place through the hole and on the exterior side wall of the rotational component, while the rotational component is stationary, the user would rotate the housing one quarter. Once the opening is lined up with the second hole, a second cord outlet may be inserted through the opening through to a second hole on the housing. While the second cord outlet is held in place through the hole and on the exterior side wall of the rotational component, while the rotational component is stationary, the user would rotate the housing. If the user would like to wrap another cord, the user may repeat the process with a third cord and a third hole. If the user would like to wrap another cord, the user may repeat the process with a fourth cord and fourth hole. An embodiment of the organizer that includes more than one insertion hole to allow the user to wrap more than one cord may involve starting the process with the initial intention of wrapping more than one cord. If the user starts the wrapping of a single cord and halfway through the process decides to wrap another cord simultaneously, then it may prove to be difficult because the insertion hole may be already blocked from the initial cord being partially wrapped. Therefore, it may be an option to start the wrapping of multiple cords with the intention to wrap more than one cord.

The cord organizer may have more than one insertion hole and would allow for more than one earbud or cord to be wrapped at the same time. The cord organizer may have four insertion holes, as seen in FIG. 1, which would allow for the wrapping of four different earbuds or cords. An embodiment of the organizer that includes more than one insertion hole to allow the user to wrap more than one cord may involve adjusting the size of the organizer to accommodate the wrapping of more than one cord.

Once the desired numbers of cord outlets are inserted through the opening through to a hole, the user would continue to rotate the housing while holding the cord outlets in place until the cords for those outlets are each retracted to the desired length. The rest of the cords may wrap around the inner circular track of the rotational component 230. The cords may wrap around the inner circular track of the rotational component until the cords are fully retracted and only earbuds or the USB hub 130 would be exposed in the opening 240.

The embodiment in FIG. 1 also illustrates how the cord organizer may be used when the cord is not fully retracted. In addition to the storage and transportation of the cord, the cord organizer may be used to adjust the length of the cord to an appropriate length. The cord may be half-retracted to allow the earbuds to be used while maintaining an exposed cord at the appropriate length.

Figure 6A:
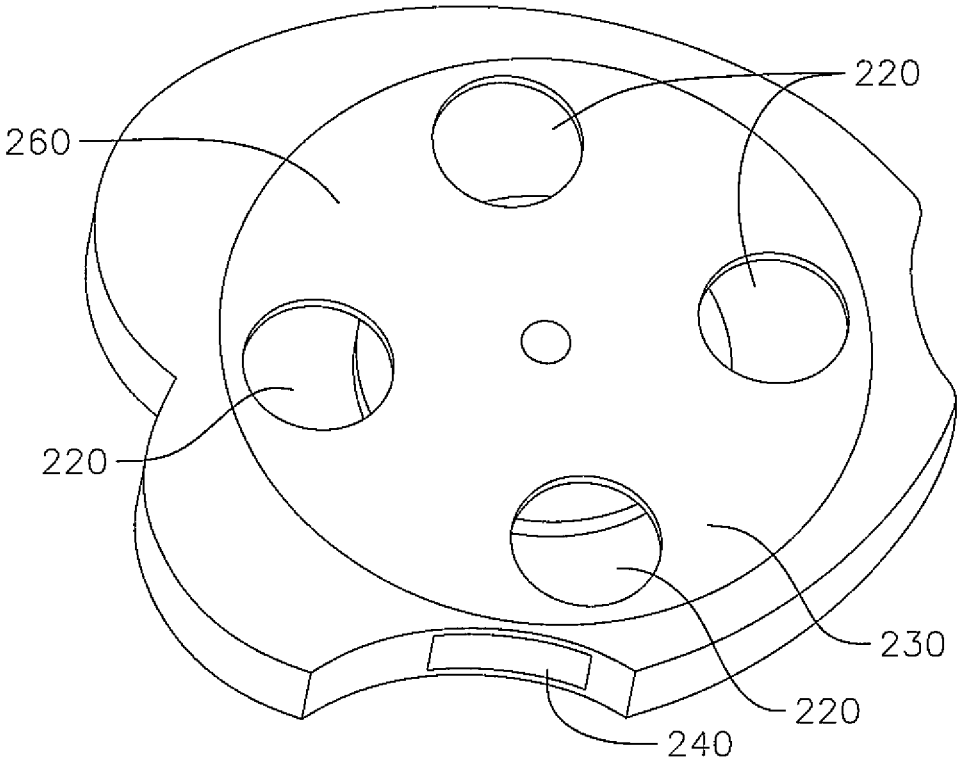
FIG. 6A is a perspective view of an embodiment of the cord organizer in the shape of an apple.
Figure 6B:
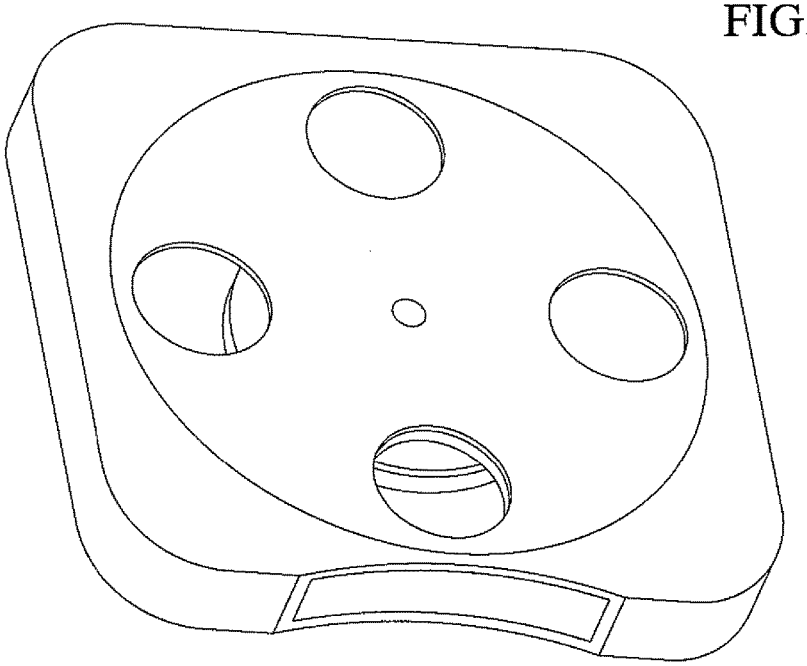
FIG. 6B is a perspective view of another embodiment of the cord organizer in the shape of a square.

Now referring to FIGS. 6A and 6B, perspective views of embodiments of the cord organizer in the shapes of an apple and a square are seen. The cord organizer may be offered in different shapes and colors. As a non-limiting example, the cord organizer may take on the shape of different fruits such as apples, pineapples, oranges, pears, and any other fruit. Moreover, the cord organizer may take on different shapes such as a square, a square with rounded edges, a square with an opening on one of the corners, a square with an opening on the flat portion, etc. In addition, the cord organizer may come in different colors. Also, the colors may be mixed to give the cord organizer a two color toned appearance, or any other combination of colors. Further, there may be different color designs like tie-die or other designs or color schemes such as school colors or the recreation of famous paintings.

Figure 6C:
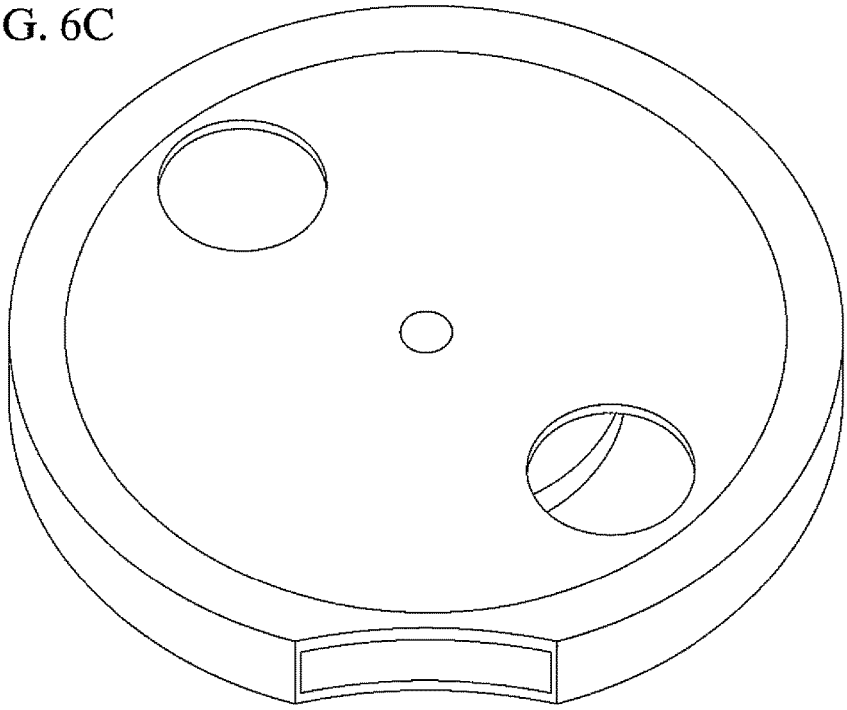
FIG. 6C is a perspective view of yet another embodiment of the cord organizer with two insertion holes.

Now referring to FIG. 6C, a perspective view of yet another embodiment of the cord organizer with two insertion holes is seen. As a non-limiting example, the organizer may have two holes. This would allow for the wrapping of more than one pair of earbuds or one cord. An embodiment of the organizer that includes more than one insertion hole to allow the user to wrap more than one cord may involve adjusting the size of the organizer to accommodate the wrapping of more than one cord.

Figure 6D:
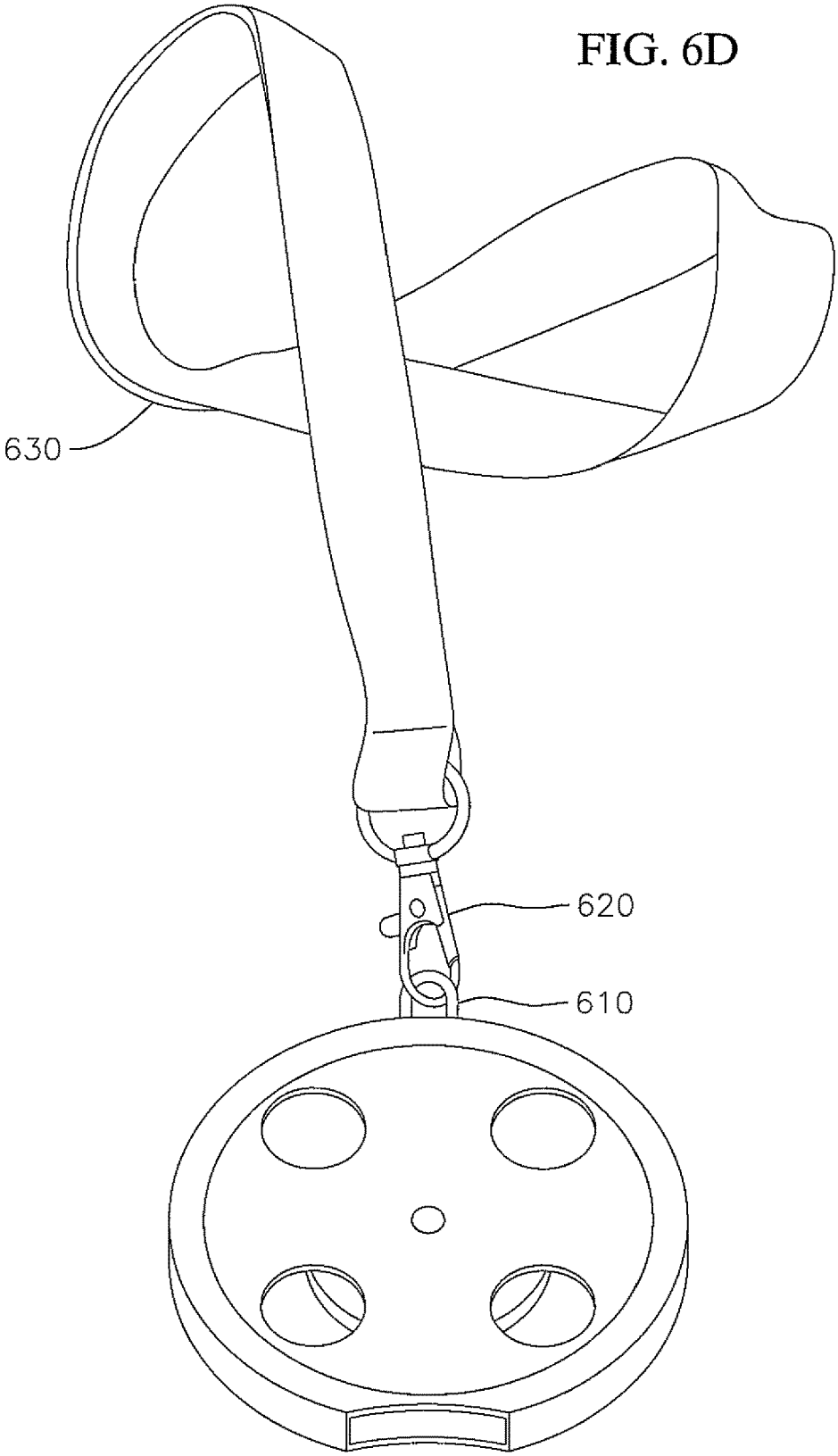
FIG. 6D is a perspective view of an embodiment of the cord organizer attached to a lanyard.

Now referring to FIG. 6D, a perspective view of an embodiment of the cord organizer attached to a lanyard is seen. The cord organizer may have optional features such as a harness or lanyard to hold the cord organizer around the neck of the user. The lanyard 630 may be a cord or strap worn around the neck or wrist. A clip 620 may connect the lanyard to the cord organizer by the use of a through-hole 610. The through-hole may be built into the edge of the cord organizer. This optional feature may prove to be useful in certain places such as for parties, gatherings, concerts, schools, field trips, museums, or other tourist destination sites.

The cord organizer may come with a glow-in-the-dark feature. The whole cord organizer, a portion, or portions may glow-in-the-dark. The glow-in-the-dark feature may be beneficial in situations like raves, parties, and in low light situations and may come in different glow-in-the-dark colors like purple, green, blue, and yellow.

In addition, the glow-in-the-dark cord organizer may be used by emergency personnel such as first responders, medical professionals, police officers, or firefighters. The different glow-in-the-dark colors may be used to identify types of personnel or groups.

As a non-limiting example, an embodiment of the cable organizer may have a housing, a rotational component, and a means for ingress and egress, through an opening, for allowing a cable to enter the housing, and for allowing the cable to exit the housing. The cable organizer may not have a circumferential edge wall, and thereby would look like a film reel. The user may place the plug at one end of a cable or cord into an insertion hole or through an open edge (means for ingress) and then rotate the organizer in order to wind the cord. The other end of the cable or cord may be allowed to exit from the housing through an opening or through the open edge (means for egress).

The cord organizer may prolong the life of cords or cables. Unlike existing organizers, the cord organizer does not require an independent tension mechanism to wrap or unwrap cords or cables. Instead the cord organizer may use friction to hold the cords or cables in place when wrapped and may require a force provided by the hand and arm strength of an average user to overcome the friction between the components. Since cords and cables may be very thin wires covered by a coating they may have a tendency to be fragile. As such, due to the lack of constant tension, as typically provided by independent tension mechanisms, there may not be constant wear and tear on the cord or cables. Therefore, the life of the cord or cables may be prolonged.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claim.

What is claimed is:

1. A cable organizer comprising:

a housing further comprising a housing inner circular track, an opening, and an attachment hole therein, and a side wall for the housing that is an exterior surface of the cable organizer that is opposite an exterior side wall of a rotational component once assembled, a circumferential edge wall that is a narrow edge that extends orthogonally from the side wall for the housing additionally comprising a lip that is a narrow flange that extends inward orthogonally from the circumferential edge wall, and a curved arcuate slice in the housing that removes a portion of the side wall, circumferential edge, and lip to create an edge opening;

the rotational component further comprising at least one hole on a surface of the rotational component, further comprising a rotational inner circular track wherein the rotational inner circular track operably connects with the housing inner circular track, thereby providing friction, and an insertion hole receiver; and a plug, wherein the plug is inserted through the attachment hole on the housing and continues to the insertion hole receiver whereby the plug operably holds the cable organizer together.

2. The cable organizer of claim 1, wherein the rotational component further comprises at least two holes on the surface.

3. The cable organizer of claim 1, wherein the friction is provided by a surface texture used for the inner track of the housing or the rotational component or both.

4. The cable organizer of claim 1, wherein the plug has an orthogonal shape and the hole attachment has a matching orthogonal shape wherein the orthogonal shape plug fits securely into the orthogonal shape hole attachment.

5. The cable organizer of claim 1, comprising a harness wherein the harness attaches the cable organizer to a user.

6. The cable organizer of claim 1, wherein the cable organizer is substantially square shaped.

7. The cable organizer of claim 1, wherein the cable organizer is substantially shaped like an apple.

8. The cable organizer of claim 1, wherein at least a portion of the cable organizer glows in the dark.

9. A cable organizer comprising:

a housing comprising a side wall that is an exterior surface of the cable organizer, a circumferential edge wall that is a narrow edge that extends orthogonally from the side wall of the housing further comprising a lip that is a narrow flange that extends inward orthogonally from the circumferential edge wall, a means for ingress comprising a curved arcuate slice in the housing that removes a portion of the side wall, circumferential edge wall, and lip to create an edge opening for allowing a cable to enter the housing, and a means for egress for allowing the cable to exit the housing; and a rotational component operably connected to the housing so as to be able to rotate with respect to the housing against friction and comprising an exterior side wall of the rotational component that is opposite the exterior surface of the side wall for the housing once assembled.

10. The cable organizer of claim 9, wherein the rotational component further comprises at least one hole on a surface to provide the means for egress.

11. The cable organizer of claim 9, comprising a harness wherein the harness attaches the cable organizer to a user.

12. The cable organizer of claim 9, wherein at least a portion of the cable organizer glows in the dark.

* * * * *